US009212528B2

(12) United States Patent
Black

(10) Patent No.: US 9,212,528 B2
(45) Date of Patent: Dec. 15, 2015

(54) LOCK ASSEMBLY WITH CAGELESS DOGS

(71) Applicant: Steven S. Black, Houston, TX (US)

(72) Inventor: Steven S. Black, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 381 days.

(21) Appl. No.: 13/717,019

(22) Filed: Dec. 17, 2012

(65) Prior Publication Data

US 2014/0166315 A1 Jun. 19, 2014

(51) Int. Cl.
*E21B 23/02* (2006.01)

(52) U.S. Cl.
CPC ..... *E21B 23/02* (2013.01)

(58) Field of Classification Search
CPC ..... E21B 23/02; E21B 33/1295
See application file for complete search history.

(56) References Cited

U.S. PATENT DOCUMENTS

| | | | | | |
|---|---|---|---|---|---|
| 2,673,614 | A | * | 3/1954 | Miller | 166/214 |
| 3,420,308 | A | * | 1/1969 | Putch | 166/208 |
| 3,856,081 | A | * | 12/1974 | Canalizo | 166/123 |
| 3,893,717 | A | * | 7/1975 | Nelson | 285/3 |
| 4,051,897 | A | | 10/1977 | Kingelin | |
| 4,069,865 | A | | 1/1978 | Gazda et al. | |
| 4,139,059 | A | * | 2/1979 | Carmichael | 166/208 |
| 4,167,970 | A | * | 9/1979 | Cowan | 166/208 |
| 4,295,665 | A | * | 10/1981 | Pierce | 285/3 |
| 4,510,995 | A | | 4/1985 | Krause, Jr. et al. | |
| 4,545,434 | A | | 10/1985 | Higgins | |
| 4,583,591 | A | | 4/1986 | Krause, Jr. et al. | |
| 4,651,818 | A | * | 3/1987 | Johnson et al. | 166/115 |
| 4,730,851 | A | * | 3/1988 | Watts | 285/4 |
| 4,745,974 | A | | 5/1988 | Higgins | |
| 4,767,145 | A | * | 8/1988 | Bullard | 294/86.18 |
| 4,773,477 | A | * | 9/1988 | Putch | 166/206 |
| 4,944,345 | A | | 7/1990 | Mashaw, Jr. | |
| 4,962,813 | A | | 10/1990 | Welch | |
| 4,986,362 | A | | 1/1991 | Pleasants | |
| 5,348,087 | A | | 9/1994 | Williamson, Jr. | |
| 5,398,764 | A | | 3/1995 | Collins | |
| 5,542,475 | A | * | 8/1996 | Turner et al. | 166/387 |

(Continued)

FOREIGN PATENT DOCUMENTS

| | | | |
|---|---|---|---|
| GB | 2366310 | A | 3/2002 |
| WO | 2011028573 | A2 | 5/2011 |
| WO | 2012013136 | A2 | 9/2012 |

OTHER PUBLICATIONS

"Dog-lock", http://petrowiki.org/Glossary%3ADog-lock, printed Jun. 16, 2015.*

(Continued)

*Primary Examiner* — Jennifer H Gay
(74) *Attorney, Agent, or Firm* — Cantor Colburn LLP

(57) ABSTRACT

A lock assembly including a plurality of dogs, each dog being circumferentially adjacent to at least one other dog in the plurality and each dog including a load bearing surface. An extender body is operatively arranged to transition the plurality of dogs between a retracted configuration and an extended configuration. The load bearing surface of each dog is operatively arranged in the extended configuration for engaging against a shoulder of a radially adjacent structure for supporting the lock assembly. The load bearing surfaces of the dogs together form a substantially circumferentially continuous shape when arranged in one of the retracted or extended configurations. And method of locking radially adjacent components.

19 Claims, 6 Drawing Sheets

(56) References Cited

U.S. PATENT DOCUMENTS

| | | | | |
|---|---|---|---|---|
| 5,984,008 | A * | 11/1999 | Lang et al. | 166/208 |
| 6,516,889 | B1 * | 2/2003 | Lembcke et al. | 166/381 |
| 7,360,594 | B2 | 4/2008 | Giroux et al. | |
| 7,455,118 | B2 * | 11/2008 | Roberts et al. | 166/387 |
| 8,490,691 | B2 | 7/2013 | Purkis | |
| 8,596,350 | B2 * | 12/2013 | Fay et al. | 166/217 |
| 8,607,860 | B2 | 12/2013 | Avant et al. | |
| 2007/0227745 | A1 * | 10/2007 | Roberts et al. | 166/386 |
| 2009/0114401 | A1 | 5/2009 | Purkis | |
| 2012/0186804 | A1 | 7/2012 | Fay et al. | |
| 2012/0186805 | A1 * | 7/2012 | Fay et al. | 166/240 |
| 2012/0186806 | A1 | 7/2012 | Fay et al. | |
| 2014/0166314 | A1 * | 6/2014 | Black | 166/382 |
| 2014/0166315 | A1 * | 6/2014 | Black | 166/382 |

OTHER PUBLICATIONS

"dog", http://www.thefreedictionary.com/dog, printed Jun. 16, 2015.*

Wireline Solutions Downhole Completion Tools, [online]; [retrieved on Feb. 14, 2012]; retrieved from the Internet www.wirelinesolutions.net/uploads/Blanking_Plugs.pdf, "Blanking Plugs," 21p.

GB Search Report for Application No. GB1221258.5 Mailed on Feb. 19, 2013, 5 pages.

GB Search Report for Application No. GB1221256.9 Mailed on Feb. 26, 2013, 5 pages.

* cited by examiner

LOCK ASSEMBLY WITH CAGELESS DOGS

BACKGROUND

Lock assemblies are ubiquitous in the downhole drilling and completions industry. One common type of lock assembly involves locking a plug, choke, pressure holding device, tool, etc., in place by radially extending a plurality of dogs into engagement with corresponding features of a radially disposed tubular. In order to accommodate the dogs of current systems, windows must be formed in a housing or mandrel, with relatively narrow struts located between each window. The struts present likely failure points when the string experiences high pressure situations and loading through the struts. The above arrangement results in the need to balance the width of the dogs and the width of the struts, as making either too small can result in failure of the system (i.e., the lock disengaging due to insufficient load bearing area between the dogs and corresponding recesses or features, the fracture of the struts during heavy loading, etc.). In view of the foregoing issues and the prevalence of dog type locking systems in the industry, advances and alternatives in the field of lock assemblies are always well received.

BRIEF DESCRIPTION

A lock assembly, including a plurality of dogs, each dog being circumferentially adjacent to at least one other dog in the plurality and each dog including a load bearing surface; and an extender body operatively arranged to transition the plurality of dogs between a retracted configuration and an extended configuration, the load bearing surface of each dog operatively arranged in the extended configuration for engaging against a shoulder of a radially adjacent structure for supporting the lock assembly, wherein the load bearing surfaces of the dogs together form a substantially circumferentially continuous shape when arranged in one of the retracted or extended configurations.

A lock assembly including a set of dogs; an extender body operatively arranged to transition the set of dogs between a radially retracted configuration and a radially extended configuration, the load bearing surface of each dog operatively arranged in the extended configuration for engaging against a shoulder of a radially adjacent structure for supporting the lock assembly, each dog being circumferentially adjacent to at least one other dog in the set without any structural components of the lock assembly axially extending between opposite sides of the dogs or interspaced circumferentially between adjacent ones of the dogs.

A method of locking radially adjacent components including positioning a lock assembly with respect to a radially adjacent structure, the lock assembly comprising a set of dogs and an extender body, each of the dogs having a load bearing surface, each dog being circumferentially adjacent to at least one other dog in the set without any structural components of the lock assembly axially extending between opposite sides of the dogs or interspaced circumferentially between adjacent ones of the dogs; transitioning the plurality of dogs between a retracted configuration and an extended configuration with the extender body; engaging the plurality of dogs with at least one shoulder in the radially adjacent structure; and supporting the lock assembly at the radially adjacent structure with the load bearing surfaces of the dogs against the shoulder.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
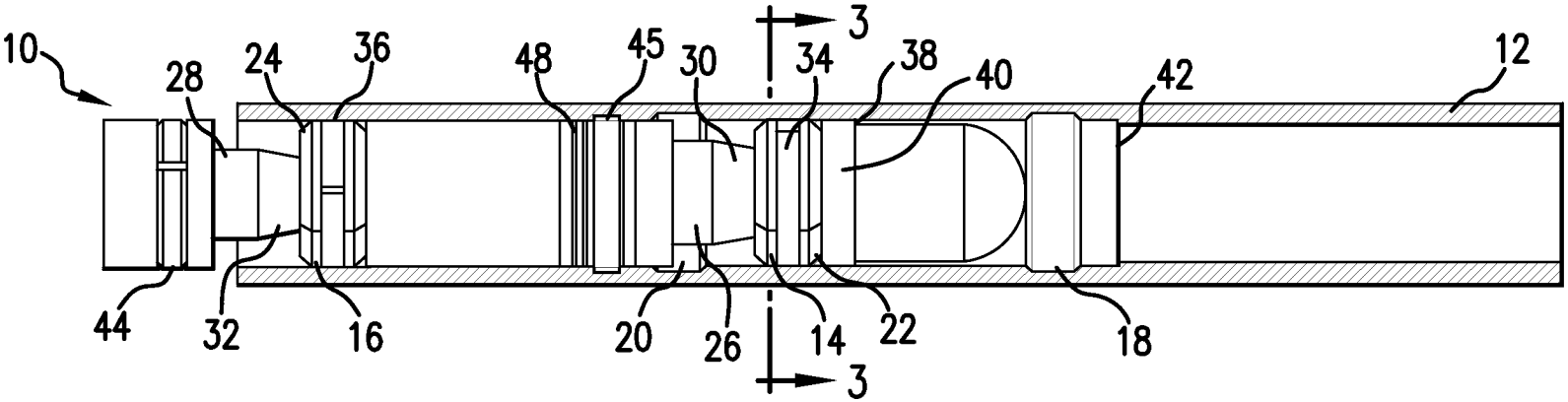
FIG. 1 is a side view of a lock assembly within an outer tubular, with the outer tubular shown in cross-section.

A detailed description of one or more embodiments of the disclosed apparatus and method are presented herein by way of exemplification and not limitation with reference to the Figures.

Referring now to the Figures, a lock assembly 10 is illustrated for locked engagement with an outer tubular 12. The outer tubular 12 could be, for example, a cased borehole, production tubular, completion tubular, or other member used in a downhole drilling and completion system. The lock assembly 10 includes a first set of dogs 14 and a second set of dogs 16, which are arranged to engage respectively with recesses 18 and 20 in the outer tubular 12 in order to lock the assembly 10 with respect to the outer tubular 12. It is to be appreciated that other numbers of sets of dogs could be included, e.g., one set, or more than two sets. The dogs 14 and 16 are shown in a disengaged or retracted configuration in FIGS. 1 and 2, with an axial cross-section of the dogs 14 shown in FIG. 3. Three of the dogs 14 are illustrated in FIG. 3, although it is to again be appreciated that other numbers could be utilized, e.g., two dogs, or more than three dogs.

In view of the drawings and description herein, it will be apparent that unlike previous lock assemblies, the assembly 10 is not arranged for the dogs 14 and/or 16 to extend radially through windows of a mandrel or outer body, but instead the assembly 10 is "cageless" or "windowless". In this way, the assembly 10 has no struts or other structural components extending axially between opposite sides of the dogs 14 and/or 16 and located in circumferential gaps between adjacent dogs or otherwise circumferentially interspaced between adjacent dogs. Of course, various components could be positioned radially inwardly of the dogs (e.g., extending through the ring-shape generally formed by the dogs), or radially outwardly of the dogs (e.g., circumferentially surrounding the dogs), as these components could be circumferentially continuous and thus not subject to the aforementioned need to balance their widths with that of the dogs, as with the widths of struts in prior systems. It is noted that an example of an assembly having windows and struts is discussed below with respect to FIGS. 9-10, according to another embodiment of the current invention described herein.

Figure 3:
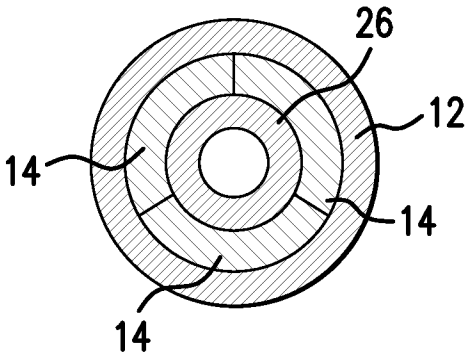
FIG. 3 is an cross-sectional view of a set of dogs of the lock assembly of FIG. 1 taken generally along line 3-3.
Figure 2:
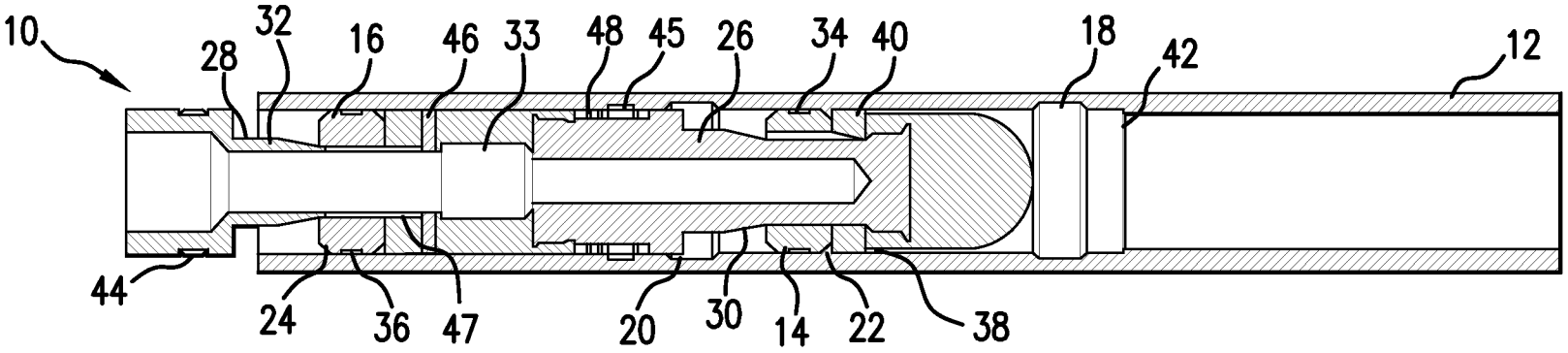
FIG. 2 is a similar view to FIG. 1, but with the lock assembly also shown in longitudinal cross-section.

Advantageously, the lack of windows and/or struts in the assembly 10 enables the load bearing surface areas of the dogs 14 and 16, depicted respectively as surface areas 22 and 24, to be maximized without affecting the structural strength of other components of the assembly 10 (i.e., there being no need to balancing the width of dogs with the widths of other structures interspaced therewith). For example, as shown in FIG. 3, the dogs 14 can be arranged such that when in a retracted position (as shown in FIGS. 1-3), the dogs 14 form a circumferentially continuous shape (e.g., a toroid), without any gaps between circumferentially adjacent ones of the dogs 14. The dogs 16 can be similarly arranged. The load bearing surfaces 22 and 24 of the dogs 14 and 16 would also be arranged in a circumferentially continuous shape when the dogs are arranged as illustrated, thereby maximizing the load bearing potential of the dogs.

Figure 5:
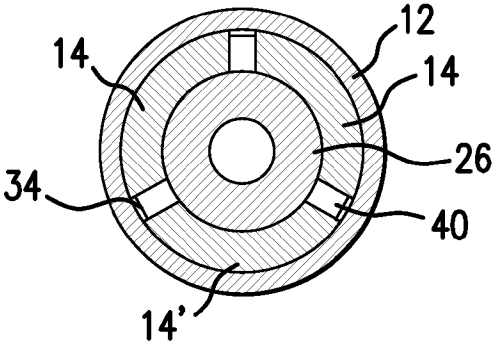
FIG. 5 is a cross-sectional view of the extended dogs in FIG. 4 taken generally along line 5-5.

It is noted that of course the dogs 14 must separate from each other when extended radially outward (e.g., in order to engage the lock assembly 10, as discussed in more detail below and illustrated in FIG. 5). Regardless, the touching of adjacent dogs to form the circumferentially continuous shape (e.g., FIG. 3) when in the retracted state maximizes the size of the load bearing surfaces 22 and 24 of the dogs 14 and 16. In other words, if gaps were necessary to be located circumferentially between adjacent dogs, such as to accommodate the presence of the aforementioned struts of prior systems, then the width and load bearing surface areas of the dogs would be limited.

It is to be appreciated that in some embodiments according to the current invention as described herein, the dogs may not be touching or there may be a small gap present circumferentially between some or all of the dogs, but the aforementioned struts or other structural members will nevertheless be unnecessary. To this end, assemblies having cageless or windowless designs can be arranged with dogs having up to their maximum possible load bearing surface areas, since, again, the dogs do not need to be interspaced with struts or other structural members whose strength and dimensions must be considered and balanced against those of the dogs.

The assembly 10 includes a first extender member or body 26 for transitioning the dogs 14 between retracted and extended configurations and a second extender member or body 28 for transitioning the dogs 16 between retracted and extended configurations. Specifically, the extender bodies 26 and 28 in the illustrated embodiment have ramped or conical sections 30 and 32, respectively, upon which the dogs 14 and 16 climb in order to so transition. In the illustrated embodiment, the extender body 28 is insertable into a bore 33 partially through the body 26. Alternatively, the body 26 could be insertable into the body 28 or the bodies 26 and 28 could be arranged to interact in some other way. It is also noted that the portion of the body 26 into which the body 28 is inserted is shown to be formed from a separate part than the portion of the body 26 that interacts with the dogs 14 for ease in manufacture, although these portions could be integrally formed or formed from more than two parts coupled together.

Figure 4:
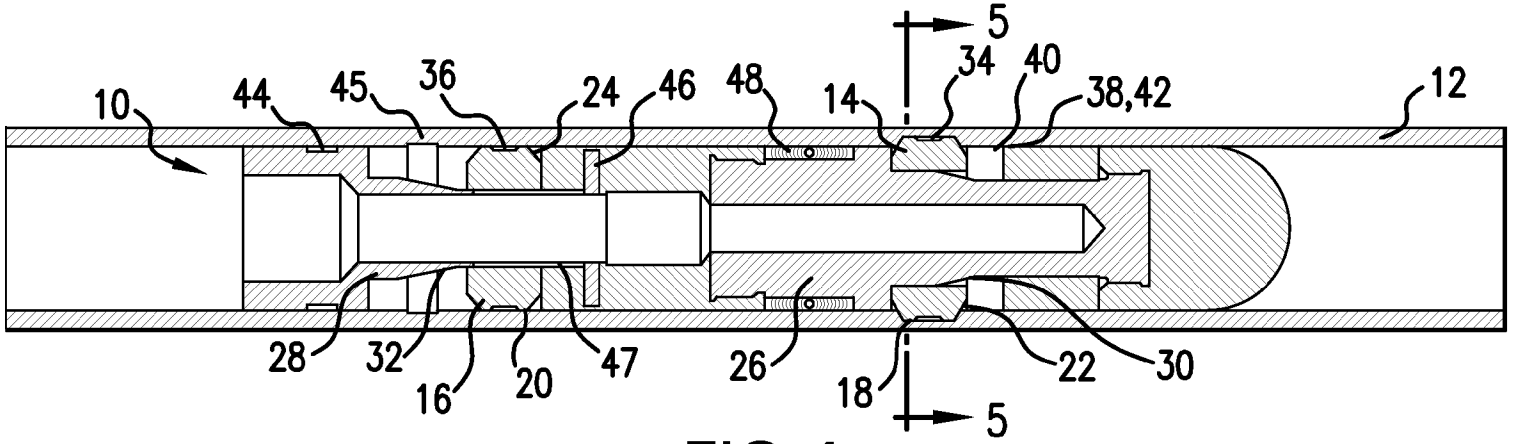
FIG. 4 is a cross-sectional view of the lock assembly of FIGS. 1 and 2 with a set of dogs engaged in a recess of the outer tubular.

As shown in FIG. 4, moving the extender body 26 axially toward the dogs 14 results in the dogs 14 climbing the ramped section 30, thereby resulting in the dogs 14 being supported at a more radially outward location, thus extending radially outwardly for engagement with the recess 18. An axial cross-section of the dogs 14 in the extended configuration is shown in FIG. 5. The dogs 16 can be similarly manipulated by axially moving the extender body 28 toward the dogs 16 to cause the dogs 16 to climb the ramped section 32. Each set of the dogs 14 ad 16 is maintained in place about its respective extender bodies 26 and 28 by a retainer or retaining member 34 and 36, respectively. The retainers 34 and 36 may be a split ring, c-spring, expandable o-ring, resilient element, etc. or other member arranged to maintained its corresponding set of dogs about its extender body in both the retracted and extended configurations.

In order to enable the relative movement necessary for the extender body 26 to be inserted through the dogs 14, the assembly 10 is equipped with a shoulder 38, which can be arranged on a stop ring 40, or other member attached thereto. The shoulder 38 of the stop ring 40 is arranged to engage with a corresponding profile 42 (e.g, a "no-go") in the outer tubular 12, thereby positioning the assembly 10 with respect to the tubular 12 when the shoulder 38 encounters the profile 42. More particularly, the stop ring 40 positions the dogs 14 and 16 proximate to their respective recesses 18 and 20 for engagement therebetween. Once stopped at the profile 42, continued force on the body 26, e.g., due to weight of the body 26 and any components attached thereto, urges the body 26 toward the dogs 14, which are held stationary by the stop ring 40, causing the dogs 14 to be extended by the body 26 as described above.

Figure 6:
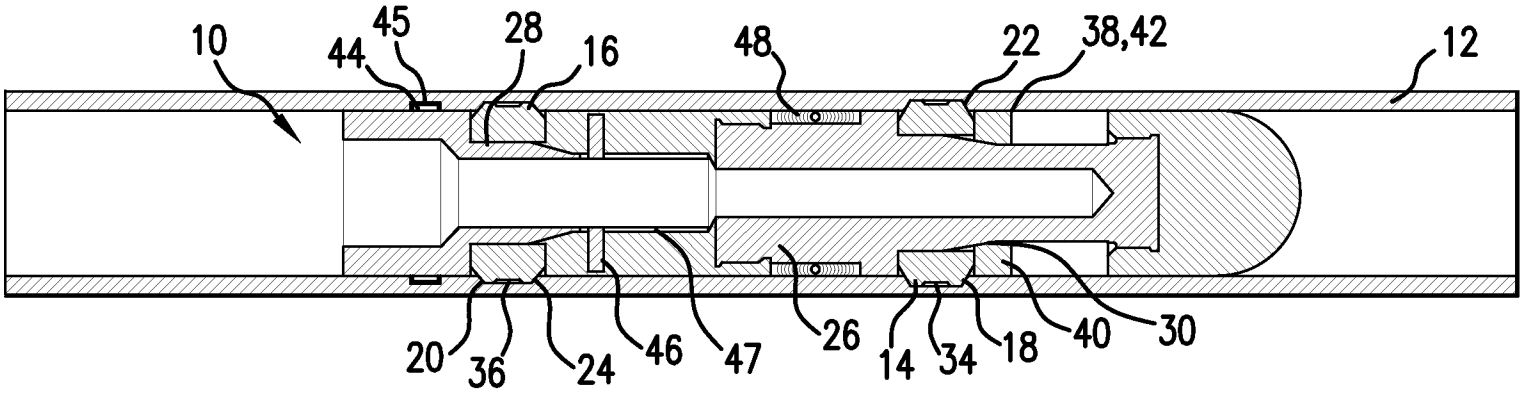
FIG. 6 is a cross-sectional view of the lock assembly of FIGS. 1 and 2 with both sets of dogs engaged in respective recesses in the outer tubular.

The dogs 16 are extended in a manner similar to that of the dogs 14. Specifically, as shown between FIGS. 4 and 6, movement of the extender body 28 axially toward the dogs 16 causes the dogs 16 to climb the ramped section 32, thereby extending the dogs 16 radially outwardly into the recess 20. As shown, relative movement between the body 28 and the dogs 16 is enabled, for example, after the body 26 has fully engaged with or bottomed out on the dogs 14, which are supported against the stop ring 40, which in turn is engaged with the profile 42 in the tubular 12. Once the body 28 has fully engaged with or bottomed out on the dogs 16, a lock ring 44 is arranged to spring or resiliently move radially outwardly for engagement with a recess 45 in the tubular 12, thereby preventing movement of the body 28 in the opposite direction and maintaining the locked configuration of the assembly 10 and the extended or engaged configuration of the dogs 14 and 16. Other releasable members or devices could be included and will be appreciated by those of ordinary skill in the art, e.g., one- or two-way ratchet profiles, magnetically attractive members in the tubular 12 and the body 28, etc.

Figure 9:
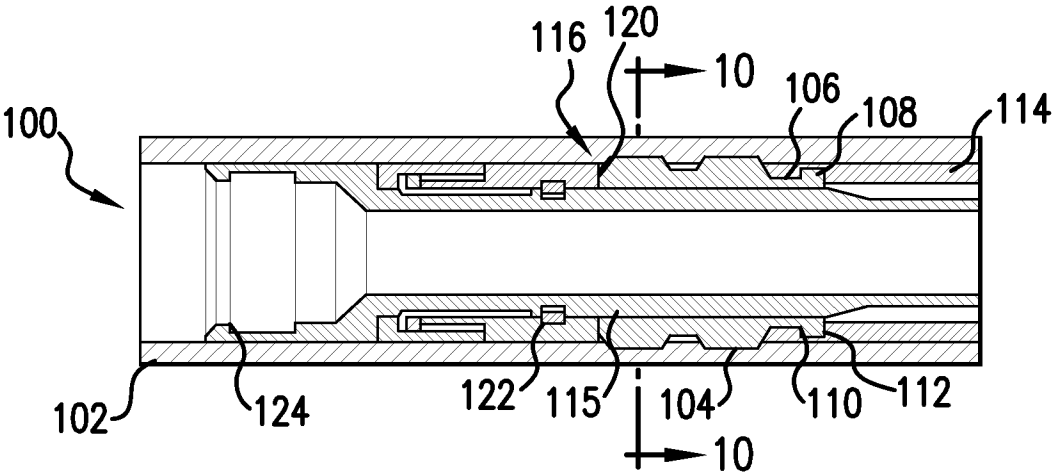
FIG. 9 is a cross-sectional view of a lock assembly according to another embodiment disclosed herein.

The body 28 could be equipped with a fishing profile, e.g., as shown in the embodiment of FIG. 9. Such a fishing profile would enable, for example, a tool in a fishing operation to grab the assembly 10 and exert a force in the up-hole direction on the assembly 10 suitable for releasing the lock ring 44 (or other release member). Once released, the body 28 can be pulled back out through the dogs 16, enabling the dogs to retract from the recess 20. The body 28 is coupled to the body 26 via pins, screws, or other coupling members 46 such that continued pulling on the body 28 causes the body 26 to also be pulled up-hole, thereby releasing the dogs 14. Once both sets of dogs 14 and 16 are released, the assembly 10 can be removed from the tubular 12.

The coupling members 46 are disposed in a slot or slots 47 in the body 28 in order to provide some degree of relative movement between the bodies 26 and 28, namely, in order to enable the body 28 to be inserted through the dogs 16 after the body 26 is bottomed out against the dogs 14 (and thus immobile in the downhole direction). The slots 47 have closed ends to enable the body 28, if equipped with a fishing profile or other retrievable means, to also pull the body 26 up-hole through the tubular 12 when the coupling member 45 is engaged with the closed ends of the slots 47. Those of ordinary skill in the art will recognize that other features or arrangements could be utilized for enabling limited relative movement between the bodies 26 and 28, e.g., forming the ends of the bodies 26 and 28 with radially overlapping lips or flanges (e.g., by forming the end of the body 26 from a separate end cap that is attached to the body 26, e.g., via threading, after the end of the body 28 is inserted through the end cap and into the bore of the body 26), etc.

The assembly 10 as illustrated in FIGS. 1-6 is to be used as a high pressure plug that isolates pressure within the tubular 12 on opposite sides of the assembly 10 from each other. To this end, the assembly 10 is arranged with a seal 48 about the body 26. The seal 48 could be located in other locations on the assembly 10. In the illustrated embodiment, the position of the seal 48 between the two sets of dogs 14 and 16 results in the assembly 10 being supported in compression against the dogs 14 during pressurization in the tubular 12 up-hole of the assembly 10, and supported in compression against the dogs 16 during pressurization in the tubular 12 downhole of the assembly 10. It is to be appreciated that in other embodiments, pressure or fluid communication between opposite sides of the assembly may be desired, such that a bore is formed entirely through the assembly, for example, as shown with respect to the embodiments of FIGS. 7-8 and 9-10, discussed in more detail below. In these alternate embodiments, the lock assembly could be used, e.g., as a hanger or for some purpose other than isolation.

Figure 7:
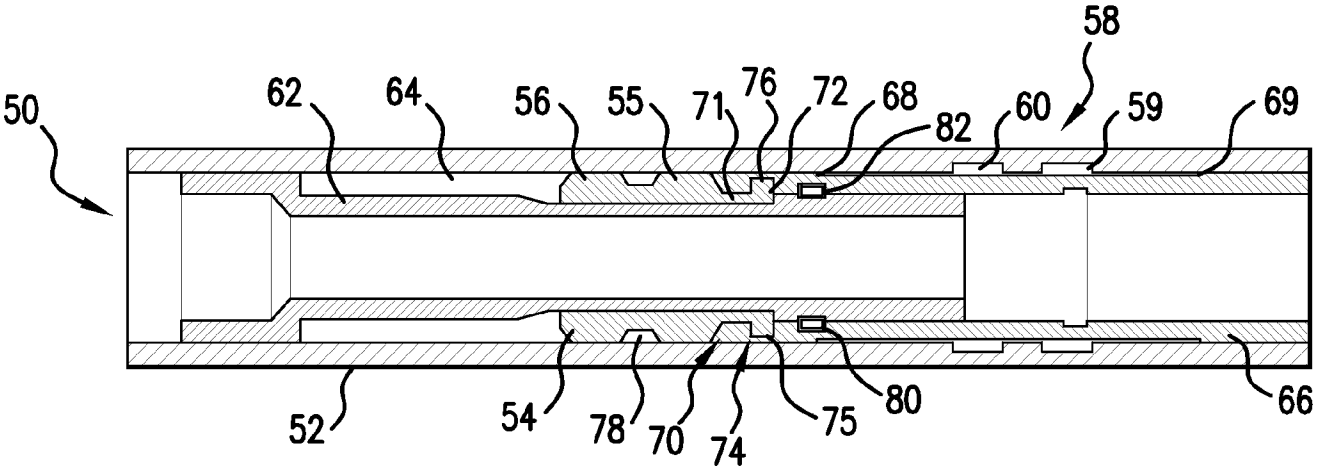
FIG. 7 is a cross-sectional view of a lock assembly according to another embodiment disclosed herein.
Figure 8:
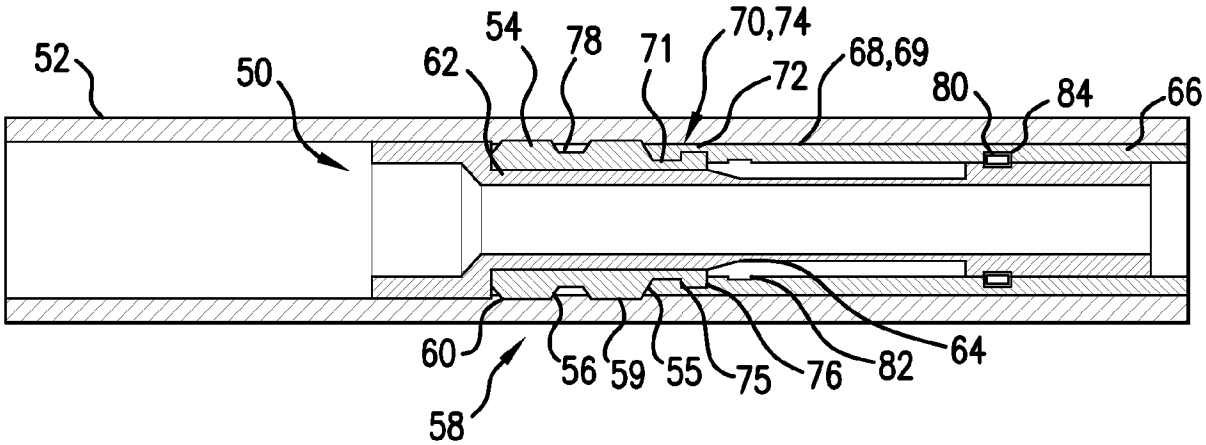
FIG. 8 is a cross-sectional view of the lock assembly of FIG. 7 in an engaged configuration.

FIGS. 7 and 8 show a lock assembly 50 according to another embodiment for enabling locked engagement with a tubular 52. Similar to the assembly 10, the assembly 50 is "cageless" in that a set of dogs 54 of the assembly 50 are not arranged to extend from windows or to include struts or other structural members circumferentially interspaced with or located between adjacent ones of the dogs 54. Only one set of dogs is shown in the assembly 50, although it should be appreciated that any number of sets could be included (e.g., two sets as shown in the assembly 10). Furthermore, the dogs 54 are shown with two profiles, designated 55 and 56, for effectively doubling the load bearing surface area of the dogs 54. Of course, any other number of profiles could be included on each dog, e.g., one or more than two.

A recess profile 58 is included in the adjacent tubular 52 and complementarily formed with respect to the dogs 54 having recesses 59 and 60 for receiving the profiles 55 and 56 of the dogs 54, respectively. The recess profile 58 receives the dogs 54 when the dogs 54 are radially extended. The dogs 54 are radially extended by use of an extender member or body 62, which, e.g., includes a ramped or conical section 64 upon which the dogs 54 will climb upon movement of the body 62 toward the dogs 54, thus operating similarly as described above with respect to the assembly 10. The transition between a retracted or disengaged configuration of the assembly 50 and an extended or engaged configuration is shown from FIG. 7 to FIG. 8.

Upon radial extension of the dogs 54 by the body 62, the dogs 54 become locked to a tube or mandrel 66, such that the mandrel 66 can be supported by hanging from the dogs 54. The mandrel 66 may include a shoulder 68, similar to the shoulder 38, for engaging a corresponding shoulder 69 of the tubular 52 in order to prevent progress of the assembly 50 through the tubular 52, locate the assembly 50 within the tubular 52, and enable the relative movement necessary for the body 62 to be inserted through the dogs 54 for extending the dogs 54. In order to lock the dogs 54 to the mandrel 66, each of the dogs 54 includes an interconnection feature 70 formed from an extension 71 terminating in a lip or flange 72. When radially retracted, the lips 72 do not radially overlap with the mandrel 66, such that the extension 71 and the lips 72 can be inserted into the mandrel 66, e.g., while configuring the assembly 50. Once the dogs 54 are radially extended by the body 62, the interconnection feature 70 becomes engaged with a corresponding interconnection feature 74 of the mandrel 66. Namely, the lips 72 become radially overlapped with a corresponding shoulder 75 of the mandrel 66, thereby enabling the mandrel 66 to hang from and/or be supported by the dogs 54 via the overlap between the lips 72 and the shoulder 75. The shoulder 75 may be formed as part of a recess, groove, or channel 76, into which the lips 72 extend. It is also noted that the extension 71, having a relatively thinner radial thickness than the lip 72, essentially forms a recess for receiving the flange or lip of the mandrel 66 that forms the shoulder 75.

It is noted that before being extended by the body 62 and/or inserted into the tubular 52, an expandable ring 78 or other resilient element, similar to the members 34 and 36, could be included to maintain the dogs 54 in a pre-assembled arrangement about the body 62. The expandable ring 78 is arranged in a "valley" between each of the profiles 56 and 58 of the dogs 54, although the ring 78 could be positioned elsewhere, or separate rings provided for each profile of the dogs 54. Also before extension of the dogs 54 by the body 62 and/or for maintaining the assembly 50 in an assembled form prior to, or during run-in, the body 62 can be releasably locked or secured to the mandrel 66. For example, the body 62 in the illustrated embodiment includes a lock ring 80, which is releasably engaged in a corresponding recess, groove, or channel 82 in the mandrel 66. Of course, other release members such as one- or two-way ratcheting, shear screws, magnetic elements, etc. could be used for creating a releaseable connection between the mandrel 66 and the body 62. In the illustrated embodiment, the lock ring 80 is re-engagable with a second recess, groove, or channel 84 in the mandrel 66 for maintaining the assembly 50 in the extended or engaged configuration. The lock ring 80 or other member can be made such that upon the body being pulled out, e.g., via a fishing tool, it re-engages the first recess 82 such that the mandrel 66 is also retrievable.

It is noted that the hanging feature provided by the interconnection features 70 and 74 also has applications for assemblies in which the dogs radially extend from windows. As noted above, such windows are undesired because they require a balancing between the width of the dogs and the width of the struts outlining the windows, since both must be load bearing components. However, the interconnection features 70 and 74 can be provided in a windowed assembly to bypass loading in the struts. For example, an assembly 100 is shown in FIG. 9 for locked engagement in a tubular 102 via a set of dogs 104. The dogs 104 substantially resemble the dogs 54 discussed above, each including an extension 106 terminating in a lip 108. Similar to the lips 72 and the mandrel 66, the lips 108 are arranged to engage with a shoulder 110 and/or in a recess, groove, or channel 112 in a mandrel 114 when the dogs 104 are radially extended by an expander member or body 115, as shown in FIG. 9.

Unlike the mandrel 66, the mandrel 114 includes a window 116 corresponding to each of the dogs 104, with each of the dogs 104 extending through its corresponding one of the windows 116. A strut 118, best seen in FIG. 10, runs axially between opposite sides of the dogs 104 in each of the gaps circumferentially between each adjacent pair of the dogs 104 for forming the windows and connecting the portions of the mandrel 114 on opposite sides of the dogs 104 together. Despite the presence of the windows 116 and the struts 118, the assembly 100 is not subject to the disadvantages of the aforementioned prior windowed lock assemblies. Specifically, the windows 116 can be arranged such that a shoulder 120 of each of the windows 116 is not engaged against the dogs 104 when a weight or force is exerted on the mandrel 114 in the downhole direction. Instead, the engagement between the lips 108 and the shoulder 110 and/or recess 112 can be arranged to pick up any such weight or force, thereby bypassing the struts 118.

Figure 10:
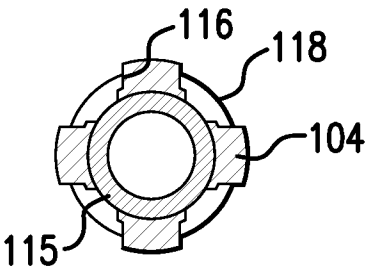
FIG. 10 is a cross-sectional view of the lock assembly of FIG. 9 taken generally along line 10-10.

In one embodiment, the windows 116 are dimensioned such that the shoulders 120 engage against the dogs 104 along with the lips 108 engaging the shoulder 110, such that any weight or loading is shared between the struts 118 and the lips 108 of the dogs 104. In this way, the dogs 104, due to the extensions 106 and the lips 108, can be arranged to bear all or some of the weight of the mandrel 114 or any component hung or connected thereto. As a result, the width of the struts 118 can be minimized without compromising structural integrity, and the width of the dogs 104 enlarged to increase the load bearing potential of the assembly 100. It is noted that although each of the dogs 104 and the struts 118 are shown in FIG. 10 to occupy approximately an equal circumferential portion about the body 115, the width of the dogs 104 can be set to occupy a larger percentage, as desired, since the dogs 104 can be arranged to bypass loading in the struts 118 due to the interconnection formed by the lips 108 and the shoulder 110.

Similar to the above discussed embodiments, a lock ring 122 or other releasable member can be included to enable selective release and engagement between the expander body 115 and the mandrel 114. Additionally, the body 115 may include a fishing neck or profile 124 for enabling a fishing tool or the like to grab the body 115 and pull in the up-hole direction in order to release the lock ring 122 or other release member from a corresponding recess or groove in the mandrel 114, moving the body 115 back through the dogs 104, and disengaging the dogs 54 from their corresponding recess in the tubular 102.

It should be appreciated that combinations of features from the assemblies 10, 50, and 100 could be interchanged as desired among various embodiments. For example, the multiple profiles of the dogs 54 could be utilized in the assemblies 10 or 100, multiple sets of dogs could be added to the assemblies 50 or 100, the fishing profile of the assembly 100 added to the assemblies 10 or 50, the seals 48 added between the mandrel 66 and the tubular 52, etc. It is additionally to be recognized that the dogs in the various embodiments disclosed herein could be rearranged to extend in a different direction, e.g., extend radially inwardly for engaging recesses in radially inwardly positioned component. It is to be appreciated that if extended radially inwardly, then the circumferentially continuous shape or surface would be formed when the dogs are moved closer together in the radially inwardly extended position, as oppose to the illustrated embodiments in which the dogs form the circumferentially continuous load bearing surface in the radially inwardly retracted position. Additionally, the components could be arranged to engage and disengage due to movement or forces in different directions than those given in the exemplary embodiments discussed above, e.g., setting the dogs with movement in the up-hole direction, via rotation of the extender body, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A lock assembly, comprising:

a plurality of cageless dogs, each dog being circumferentially adjacent to at least one other dog in the plurality and each dog including a load bearing surface; and an extender body operatively arranged to transition the plurality of dogs between a retracted configuration and an extended configuration, the load bearing surface of each dog operatively arranged in the extended configuration for engaging against a shoulder of a radially adjacent structure for supporting the lock assembly, wherein the load bearing surfaces of the dogs together form a circumferentially continuous shape when arranged in the retracted configuration and wherein adjacent dogs are in contact with each other in the retracted position.

2. The lock assembly of claim 1, further comprising a second plurality of dogs, the second plurality of dogs displaced from the first plurality of dogs and arranged with each dog in the second plurality being circumferentially adjacent to at least one other dog in the second plurality.

3. The lock assembly of claim 2, further comprising a second extender body operatively arranged to transition the second plurality of dogs between corresponding retracted and extended configurations, the dogs in the second plurality forming a substantially circumferentially continuous load bearing surface when arranged in one of the corresponding retracted and extended configurations.

4. The lock assembly of claim 3, wherein a seal is positioned between the plurality of dogs and the second plurality of dogs for isolating the plurality of dogs and the extender body from the second plurality of dogs and the second extender body.

5. The lock assembly of claim 4, wherein hydraulic pressure exerted on the assembly on either side of the seal results in the assembly being supported in compression against at least one of the plurality of dogs or the second plurality of dogs when the plurality of dogs and the second plurality of dogs are in their respective extended configurations.

6. A tubular system comprising the lock assembly of claim 1 disposed with a radially adjacent structure, the radially adjacent structure including a recess operatively arranged to receive the plurality of dogs when in the extended configuration, the recess having at least one shoulder for engaging with the load bearing surfaces of the dogs.

7. The system of claim 6, wherein the radially adjacent structure is a downhole tubular positioned radially outwardly about the lock assembly.

8. The system of claim 6, wherein the lock assembly further comprises a stop ring operatively arranged to engage a profile in the radially tubular for positioning the plurality of dogs with respect to the recess in the radially adjacent tubular.

9. The system of claim 6, further comprising a seal arranged between the lock assembly and the radially adjacent structure for isolating opposite sides of the lock assembly from each other.

10. The system of claim 6, further comprising a release member operatively arranged to releasably secure the lock assembly and the adjacent component together.

11. The lock assembly of claim 1, wherein the dogs move radially outwardly while transitioning from the retracted configuration to the extended configuration.

12. The lock assembly of claim 1, further comprising a mandrel or tube hanging from the plurality of dogs.

13. The lock assembly of claim 12, further comprising a release member operatively arranged for releasably securing the mandrel or tube to the extender body.

14. The lock assembly of claim 12, wherein the mandrel or tube is hung from the plurality of dogs via one or more shoulders forming an interconnection therebetween when the dogs are in the extended configuration.

15. The lock assembly of claim 1, wherein each dog in the plurality has multiple profiles associated with multiple load bearing surfaces oriented with respect to the same direction.

16. A lock assembly comprising:

a plurality of cageless dogs, each dog being circumferentially adjacent to at least one other dog in the plurality and each dog including a load bearing surface;

an extender body operatively arranged to transition the plurality of dogs between a retracted configuration and an extended configuration, the load bearing surface of each dog operatively arranged in the extended configuration for engaging against a shoulder of a radially adjacent structure for supporting the lock assembly, wherein the load bearing surfaces of the dogs together form a substantially circumferentially continuous shape when arranged in the refracted configuration; and, a retainer arranged at least partially circumferentially with the plurality of dogs, concentric with and at a same longitudinal location as the plurality of dogs, for maintaining an arrangement of the plurality of dogs with the extender body.

17. The lock assembly of claim 16, wherein the retainer is at least one of a resilient element, a c-spring, and a split ring.

18. A method of locking radially adjacent components, comprising:

positioning a lock assembly with respect to a radially adjacent structure, the lock assembly comprising a set of cageless dogs and an extender body, each of the dogs having a load bearing surface, each dog being circumferentially adjacent to and in contact with at least one other dog in the set without any structural components of the lock assembly axially extending between opposite sides of the dogs or interspaced circumferentially between adjacent ones of the dogs;

maintaining the dogs on the extender body by a retainer concentric with the dogs and located at a same longitudinal location as the dogs;

transitioning the plurality of dogs between a retracted configuration and an extended configuration with the extender body;

engaging the plurality of dogs with at least one shoulder in the radially adjacent structure; and supporting the lock assembly at the radially adjacent structure with the load bearing surfaces of the dogs against the shoulder.

19. The method of claim 18, wherein the load bearing surfaces of the dogs form a substantially circumferentially continuous shape when in one of the refracted or extended configurations.

* * * * *